US005156855A

United States Patent [19]

Hisatomi et al.

[11] Patent Number: 5,156,855

[45] Date of Patent: Oct. 20, 1992

[54] APPARATUS FOR PRESSURE SLIP CASTING

[75] Inventors: Katsuki Hisatomi; Yoshiyuki Hurushawa; Masaharu Yasui; Setuzi Sato, all of Fukuoka, Japan

[73] Assignee: Toto Ltd., Fukuoka, Japan

[21] Appl. No.: 609,695

[22] Filed: Nov. 6, 1990

[30] Foreign Application Priority Data

Nov. 6, 1989 [JP] Japan ..... 1-288165

[51] Int. Cl.[5] ..... B28B 1/26

[52] U.S. Cl. ..... 425/84; 249/113; 249/137; 249/141; 264/86; 425/86; 425/451.9

[58] Field of Search ..... 249/137, 141, 113; 264/86, 87, 302, 304; 425/84, 85, 86, 451.9

[56] References Cited

U.S. PATENT DOCUMENTS

| | | | |
|---|---|---|---|
| 2.540,199 | 2/1951 | Gorlinski | 249/137 |
| 3.536,799 | 10/1970 | Spy | 264/86 |
| 3.691,266 | 9/1972 | Greenberg | 425/84 |
| 4.043,737 | 8/1977 | Greenberg | 425/84 |
| 4.884,959 | 12/1989 | Ito et al. | 425/84 |
| 4.948,087 | 8/1990 | Hisaeda et al. | 249/141 |

FOREIGN PATENT DOCUMENTS

| | | | |
|---|---|---|---|
| 0002992 | 7/1979 | European Pat. Off. . | |
| 0332896 | 9/1989 | European Pat. Off. . | |
| 2002428 | 7/1971 | Fed. Rep. of Germany | 425/84 |
| 2657177 | 6/1978 | Fed. Rep. of Germany | 425/84 |
| 2601894 | 12/1967 | France . | |
| 2120408 | 8/1972 | France . | |
| 2437777 | 6/1980 | France | 425/84 |
| 1505637 | 1/1988 | France . | |
| 63-31709 | 2/1988 | Japan . | |
| 1150072 | 4/1985 | U.S.S.R. | 249/141 |

*Primary Examiner*—Jay H. Woo
*Assistant Examiner*—Scott Bushey
*Attorney, Agent, or Firm*—Irving M. Weiner; Joseph P. Carrier; Pamela S. Burt

[57] ABSTRACT

A shaped article such as a sanitary pottery product is formed through a pressure slip casting process. A mold having a molding cavity defined therein and a slip inlet/outlet hole communicating with the molding cavity is positioned on the support surface of a mold table while the mold table is being maintained horizontally. Then, the mold table is tilted through a first angle with respect to a horizontal plane so that an inner end of the slip inlet/outlet hole is positioned near a lowermost end of the molding cavity in the mold. Thereafter, a slip is introduced under pressure into the molding cavity through the slip inlet/outlet hole. After the clay of the introduced slip is deposited to a desired thickness, the excess slip is discharged from the molding cavity through the slip inlet/outlet hole.

8 Claims, 5 Drawing Sheets

APPARATUS FOR PRESSURE SLIP CASTING

BACKGROUND OF THE INVENTION

1. Field of the Invention

The present invention relates to a method of and an apparatus for pressure slip casting of pottery articles such as sanitary ware.

2. Description of the Relevant Art

As disclosed in Japanese Laid-Open Patent Publication No. 63(1988)-31709, for example, there is known a pressure slip casting apparatus in which a slip is poured into a mold placed horizontally on a mold table, and after a desired shaped article is produced in the mold, the excess slip is discharged from the mold. According to the disclosed pressure slip casting apparatus, the assembled mold is clamped vertically and laterally and placed horizontally on the mold table, and then the slip is poured into the mold and the excess slip is poured from the mold after the desired product is formed in the mold.

The mold has a slip inlet/outlet hole defined in a lower portion thereof. When the slip is introduced through the slip inlet/outlet hole into the molding space or cavity in the mold, air in a region near the inlet/outlet hole tends to be trapped in the slip. Since the air trapped in the slip cannot easily escape from the slip, the article produced in the mold is highly likely to contain unwanted cavities therein. In order to prevent air from being trapped in the slip, the slip has to be poured into the mold at a low speed. Furthermore, if the bottom of the molding cavity in the mold is flat, then the excess slurry cannot easily be discharged from the mold and it takes a long period of time to pour the excess slurry from the mold after the desired ware is formed in the mold. Therefore, the time required to mold a desired shaped product is long and the rate of production of such shaped articles is low.

SUMMARY OF THE INVENTION

It is an object of the present invention to provide a method of and an apparatus for pressure slip casting, which prevent air from being trapped in a slip when the slip is introduced into a mold, so that high-quality articles can be produced, and which can introduce a slip into a mold and discharge an excess slip from the mold in short periods of time, resulting in a high efficiency with which shaped articles can be produced.

According to the present invention, there is provided a method of forming a shaped article through pressure slip casting with a mold having a molding cavity defined therein and a slip inlet/outlet hole communicating with the molding cavity, and a tiltable mold table having a support surface on which the mold is to be mounted, the method comprising the steps of positioning the mold on the support surface while the mold table is being maintained horizontally, tilting the mold table through a first angle with respect to a horizontal plane so that an inner end of the slip inlet/outlet hole is positioned near a lowermost end of the molding cavity in the mold, introducing a slip into the molding cavity through the slip inlet/outlet hole, and thereafter discharging excess slip from the molding cavity through the slip inlet/outlet hole.

According to the present invention, there is also provided an apparatus for forming a shaped article through pressure slip casting, comprising a mold having a molding cavity defined therein and a slip inlet/outlet hole for supplying a slip into the molding cavity and discharging excess slip from the molding cavity, mold table means having a support surface for placing the mold thereon, the mold table means being tiltable about a central axis, tilting means for tilting the mold table means about the central axis, and positioning means for positioning the mold on the support surface of the mold table means so that an inner end of the slip inlet/outlet hole is positioned near a lowermost end of the mold cavity in the mold, when the mold table means is tilted through a first angle with respect to a horizontal plane.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
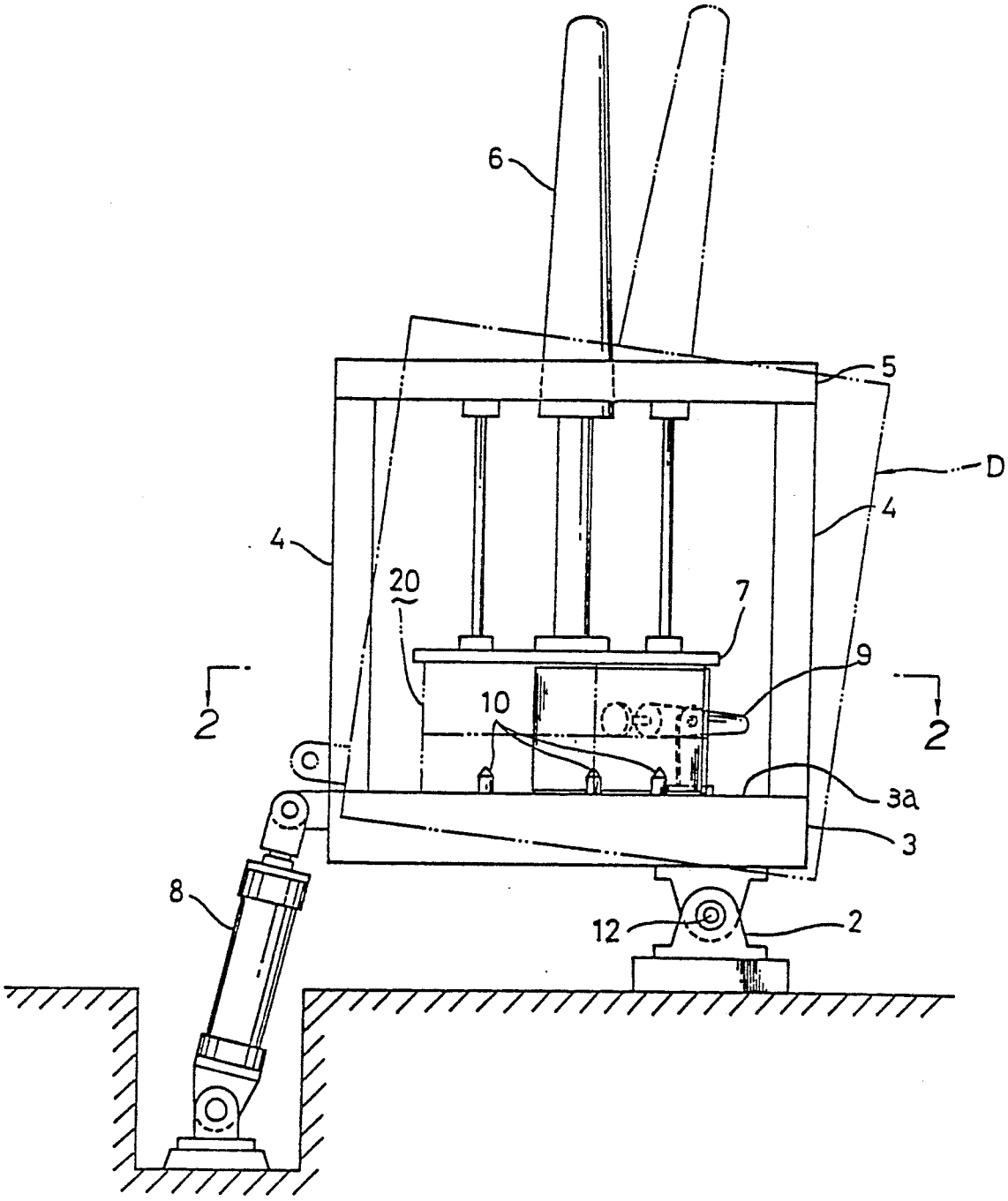
FIG. 1 is a side elevational view of a pressure slip casting apparatus according to an embodiment of the present invention.
Figure 2:
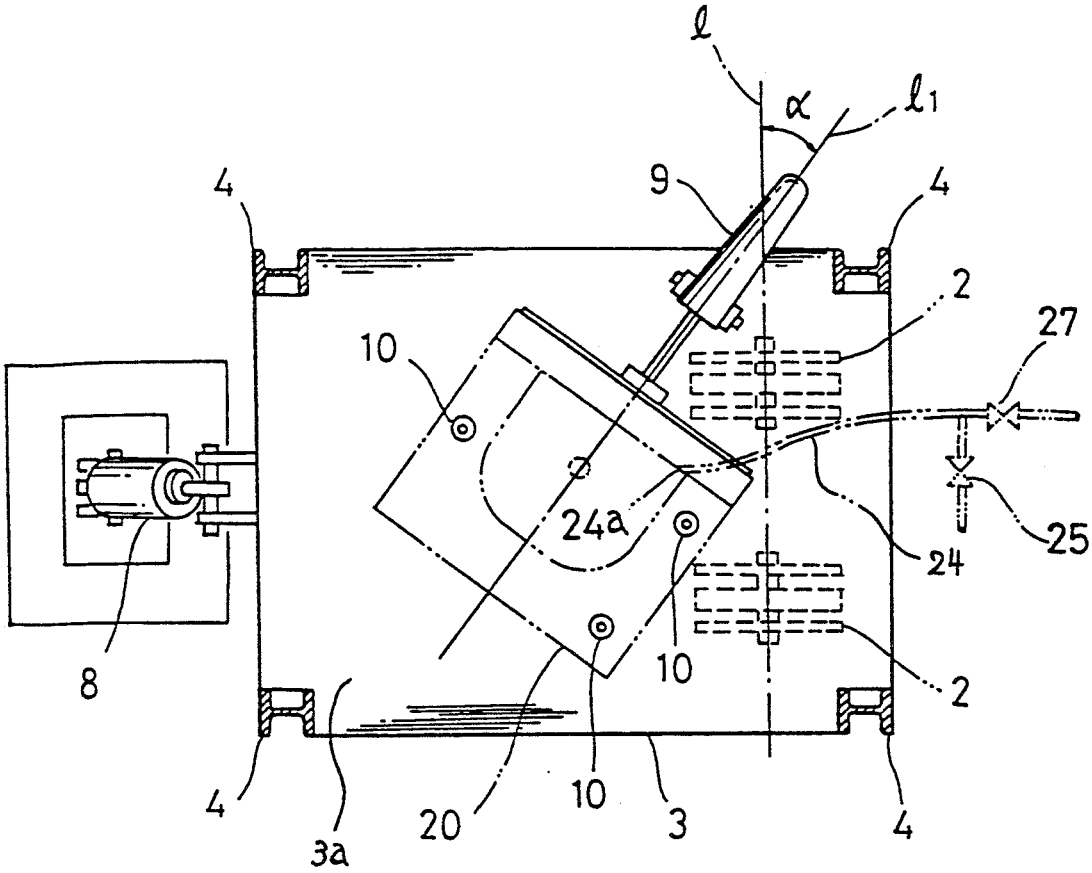
FIG. 2 is a cross-sectional view taken along line 2—2 of FIG. 1.
Figure 3:
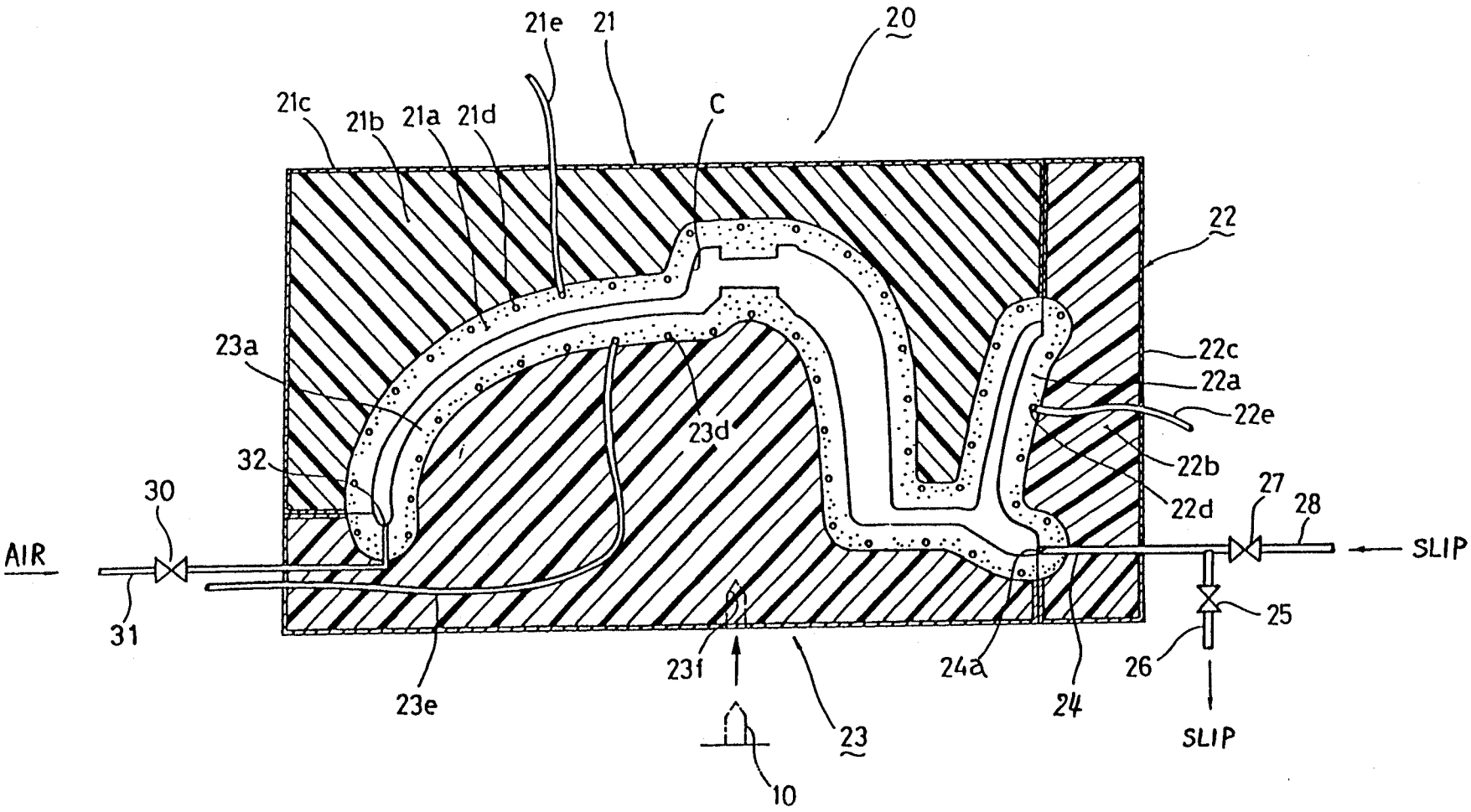
FIG. 3 is a cross-sectional view of a mold in the pressure slip casting apparatus shown in FIG. 1.

FIGS. 1 through 3 show a pressure slip casting apparatus according to an embodiment of the present invention.

As shown in FIG. 1, the pressure slip casting apparatus includes a mold table 3 having a flat upper support surface 3*a* for placing a mold 20 thereon, the mold table 3 being tiltably supported at one end thereof on bearing holders 2 through pivot shafts 12. The opposite end of the mold table 3, which is remote from the pivotally supported end, is connected to a cylinder unit 8 for tilting the mold table 3. Therefore, the mold table 3 can be tilted upwardly or downwardly when the cylinder unit 3 is expanded or contracted. The mold table 3 has four corner support posts 4 extending vertically upwardly from the support surface 3*a*, a top plate 5 mounted on the upper ends of the support posts 4, a vertical clamping cylinder unit 6 mounted on the top plate 5 and extensible and contractable perpendicularly with respect to the support surface 3*a*, and a presser plate 7 mounted on the lower distal end of the piston rod of the cylinder unit 6.

As shown in FIG. 2, the mold 20, which is of a box shape or rectangular parallelepiped, is positioned on the mold table 3 such that a horizontal central line $l_1$ of the rectangular parallelepiped of the mold 20 is inclined at an angle $\alpha$ to a central axis l of the pivot shafts 12 about which the mold table 3 can be tilted. On the mold table 3, there is also mounted a horizontal clamping cylinder unit 9 for pressing a side mold member 22 (FIG. 3) in a direction parallel to the support surface 3*a*, the horizontal clamping cylinder unit 9 having an axis aligned with the horizontal central line $l_1$ of the mold 20.

A plurality of rocket pins 10 for positioning and fixing the mold 20 are mounted on the mold table 3, the rocket pins 10 projecting upwardly from the support surface 3*a*. As shown in FIG. 3, the mold 20 has positioning recesses 23*f* defined in a lower surface thereof, for receiving the rocket pins 10 respectively in snugly fitting engagement.

In FIG. 3, the mold 20 comprises an upper mold member 21, the side mold member 22, and a lower mold member 23, which jointly define a molding space or cavity C of desired shape therebetween. The upper mold member 21 has a porous resin layer 21*a*, a water-impermeable back layer 21*b*, and an iron plate 21*c*, which are successively arranged outwardly from the molding cavity C. The porous resin layer 21*a* has a plurality of water passages 21*d* defined therein which are connected to a common water pipe 21*e* extending out of the upper mold member 21. Likewise, the side mold member 22 and the lower mold member 23 have porous resin layers 22*a*, 23*a*, respectively, water-impermeable back layers 22*b*, 23*b*, respectively, and iron plates 22*c*, 23*c*, respectively. The porous resin layers 22*a*, 23*a* have water passages 22*d*, 23*d* defined therein which are connected to common water pipes 22*e*, 23*e* extending out of the side and lower mold members 22, 23, respectively. The positioning recesses 23*f* for receiving the rocket pins 10 are defined in the lower surface of the lower mold member 23.

A slip inlet/outlet hole 24 extends through the iron plate 22*c*, the water-impermeable back layer 22*b*, and the porous resin layer 22*a* of the side mold member 22, thereby providing communication between the molding cavity C and the exterior of the mold 20. The slip inlet/outlet hole 24 has an inner end 24*a* positioned such that it is located in the lowermost end of the molding cavity C when the mold 20 is tilted through a predetermined angle in response to angular movement of the mold table 3 about the pivot shafts 12. The slip inlet/outlet hole 24 is connected to a slip discharge pipe 26 through a valve 25 outside of the mold 20 and also to a slip supply pipe 28 through a valve 27 outside of the mold 20.

The lower mold member 23 has an air hole 32 defined therein for supplying air under pressure into the molding cavity C in order to force excess slip out of the molding space C after a desired shaped product is formed in the molding cavity C. The air hole 32 is connected through a valve 30 to an air supply pipe 31 outside of the mold 20.

The pressure slip casting apparatus of the aforesaid construction operates as follows:

As shown in FIG. 1, the mold table 3 is maintained horizontally, and the mold 20 is placed on the mold table 3 with the rocket pins 10 fitted respectively in the positioning recesses 23*f*. At this time, the box-shaped mold 20 is positioned such that the horizontal central line $l_1$ of the mold 20 is inclined through the angle $\alpha$ to the central axis l about which the mold table 3 is tiltable, as shown in FIG. 2. The angle $\alpha$ is selected such that when the mold table 3 is tilted to tilt the mold 20 through a predetermined angle with respect to a horizontal plane, a slip can flow most efficiently into and out of the molding cavity C through the slip inlet/outlet hole 24. The inner end 24*a* of the slip inlet/outlet hole 24 is located at an end of the molding cavity C near a position closest to the central axis l.

The vertical clamping cylinder unit 6 (FIG. 1) is actuated to cause the presser plate 7 to press the mold 20 downwardly, and the horizontal clamping cylinder unit 9 (FIG. 2) is actuated to press the side mold member 22. The upper, side, and lower mold members 21, 22, 23 of the mold 20 are now clamped together, with the molding cavity C tightly defined therebetween.

Then, the cylinder 8 is actuated to tilt the mold table 3 into a tilted position indicated by the imaginary line D in FIG. 1, and then inactivated to hold the mold table 3 in the tilted position. At this time, the mold table 3 is tilted through a certain angle with respect to the horizontal plane, with the inner end 24*a* of the slip inlet/outlet hole 24 being at the lowermost position in the molding cavity C.

The valve 25 is closed and the valve 27 is opened. A slip is then supplied under pressure from the slip supply pipe 28 through the valve 27 and the slip inlet/outlet hole 24 into the molding cavity C.

The slip as it is introduced into the molding cavity C goes upwardly from the lowermost position in the molding cavity C, forcing air upwardly and out of the molding cavity C through the air hole 32 and the valve 30, until finally the slip fills up the molding cavity C. Therefore, the air in the molding cavity C is prevented from being trapped in the slip when it is poured into the molding cavity C.

The water contained in the slip which has been introduced into the molding cavity C passes through the porous resin layers 21*a*, 22*a*, 23*a* and through the water passages 21*d*, 22*d*, 23*d*, and is then discharged out of the mold 20 through the common water pipes 21*e*, 22*e*, 23*e*. At the same time, the clay in the slip is deposited on the surfaces of the porous resin layers 21*a*, 22*a*, 23*a* which face the molding cavity C.

After the clay has been deposited to a desired thickness, the valve 27 is closed and the valve 25 is opened. Then, the valve 30 is opened and air under pressure is supplied from a pressurized air source (not shown) through the air supply pipe 31 into the molding cavity C. The excess slip in the molding cavity C is thus forcibly discharged out of the mold 20 through the slip inlet/outlet hole 24.

When the excess slip is discharged, the cylinder unit 8 may be actuated again to change the angle at which the mold table 3 is tilted, or may be reciprocally extended and contracted to swing the mold 20, for thereby discharging the slip at a higher speed.

In the above embodiment, the mold 20 is positioned on the mold table 3 by the rocket pins 10 and the positioning recesses 23*f*. However, the mold 20 may be positioned on the mold table 3 by a positioning block, a jack bolt, a positioning cylinder unit, or the like.

In the above embodiment, the present invention is applied to the pressure slip casting apparatus in which the excess slip has to be discharged out of the mold. However, the principles of the present invention are also applicable to a solid slip casting apparatus in which no excess slip is introduced and discharged.

Figure 4:
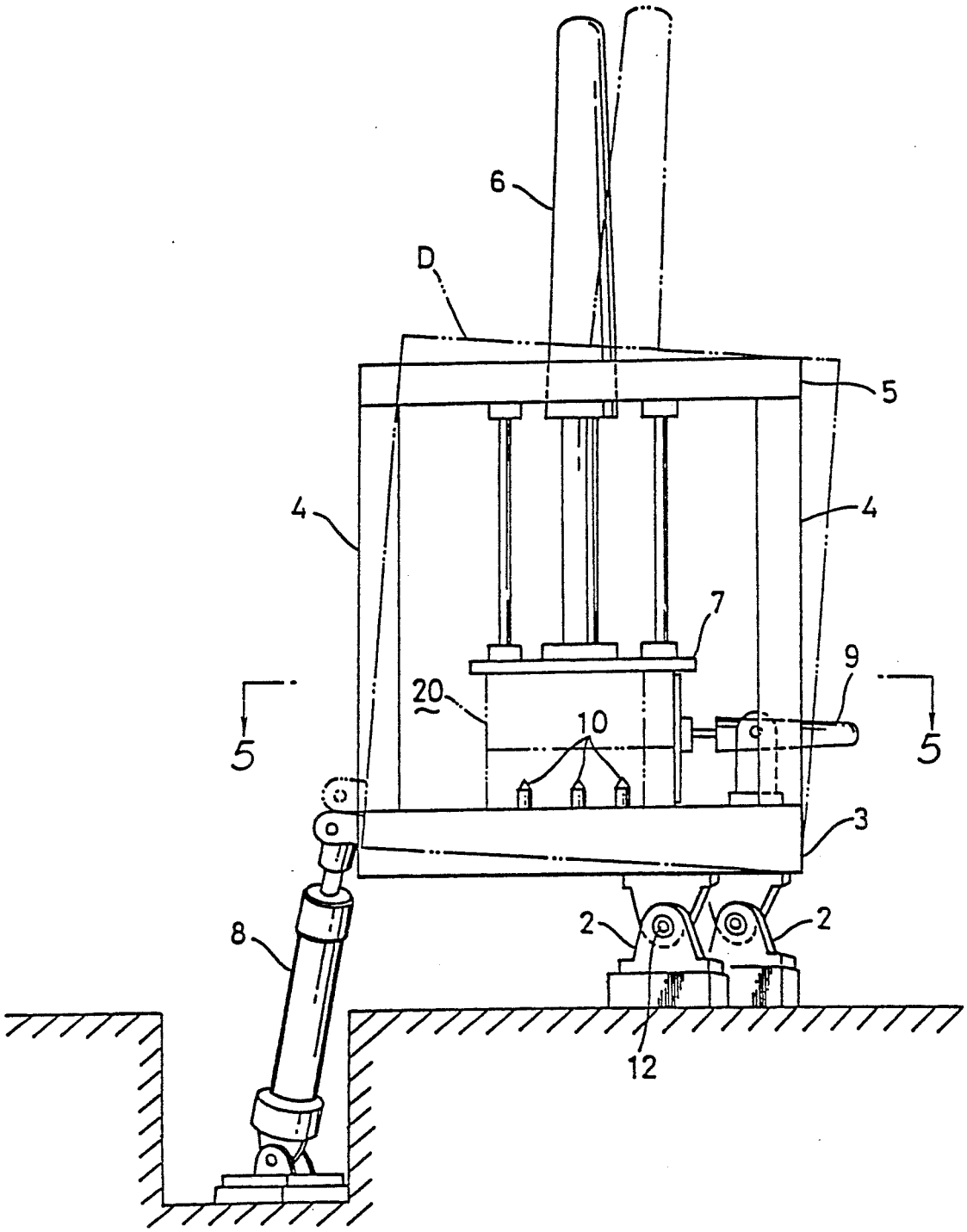
FIG. 4 is a side elevational view of a pressure slip casting apparatus according to another embodiment of the present invention.

A pressure slip casting apparatus according to the present invention will be described below with reference to FIGS. 4 and 5. Those parts show in FIGS. 4 and 5 which are identical to those of the previous embodiment are denoted by identical reference numerals, and will not be described in detail.

Figure 5:
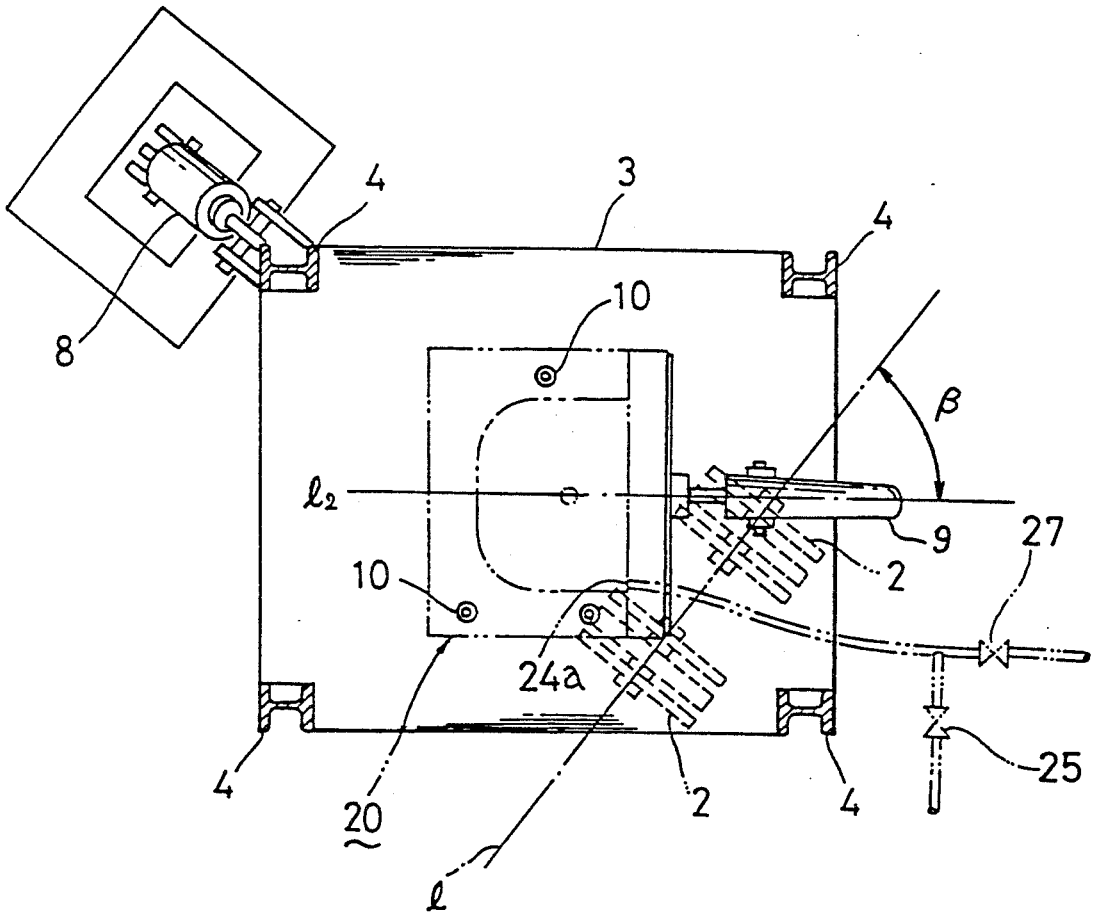
FIG. 5 is a cross-sectional view taken along line 5—5 of FIG. 4.

As shown in FIG. 5, the mold 20 has a horizontal central line $l_2$ extending parallel to a central line of the mold table 3 which is rectangular in shape, and the cylinder unit 8 for tilting the mold table 3 is connected to one corner of the mold table 3. The horizontal central line $l_2$ is inclined at an angle $\beta$ to the axis l about which the mold table 3 is tiltable by the cylinder unit 8. When the mold table 3 is tilted through a predetermined angle, the slip inlet/outlet hole 24 is also in the lowermost position according to this embodiment. The other structural details of the pressure slip casting apparatus shown in FIGS. 4 and 5 are identical to those of the pressure slip casting apparatus shown in FIGS. 1 through 3.

According to the present invention, as described above, when the slip is poured into the molding cavity, air is prevented from being trapped into the slip. Therefore, any shaped pottery products formed according to the present invention are of high and stable quality. Furthermore, the slip can be introduced into the molding cavity at high speed, and the excess slip can be discharged out of the molding cavity in a short period of time. As a result, pottery articles can be manufactured at an increased rate according to the present invention.

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

We claim:

1. An apparatus for forming a shaped article through pressure slip casting, comprising:

a mold having a molding cavity defined therein and a slip inlet/outlet hole for supplying a pressurized slip into said molding cavity and discharging excess slip from said molding cavity, said mold being constructed to forcibly receive pressurized slip therein;

mold table means having a support surface for placing said mold thereon, said mold table means being tiltable about a central axis thereof;

tilting means for tilting said mold table means about said central axis; and positioning means for positioning said mold on the support surface of said mold table means so that said central axis is offset from a longitudinal axis of said mold such that said central axis and said longitudinal axis intersect each other at an acute angle and so that an inner end of said slip inlet/outlet hole is positioned at substantially a lowest point of the mold cavity in said mold, when said mold table means is tilted about said central axis through a first angle with respect to a horizontal plane.

2. An apparatus according to claim 1, wherein said inner end of the slip inlet/outlet hole is positioned at an end of said molding cavity closest to said central axis.

3. An apparatus according to claim 1, wherein said mold is shaped as a rectangular parallelepiped, said positioning means comprises means for inclining a horizontal central line of the rectangular parallelepiped of said mold at a second angle with respect to said central axis.

4. An apparatus according to claim 1, further including clamping means for clamping said mold, said clamping means being mounted on and inclinable with said mold table.

5. An apparatus according to claim 4, wherein said clamping means comprises a vertical clamping cylinder unit extensible and contractable perpendicularly to said support surface of the mold table, and a horizontal clamping cylinder unit extensible and contractable in a plane parallel to said support surface.

6. An apparatus according to claim 5, wherein said mold is shaped as a rectangular parallelepiped, said horizontal clamping cylinder being extensible and contractable along a horizontal central line of the rectangular parallelepiped of said mold.

7. An apparatus according to claim 1, wherein said positioning means comprises securing members which secure the mold in place on the support surface of said mold table means with said central axis and said longitudinal axis intersecting each other at said acute angle.

8. An apparatus according to claim 7, wherein said securing members comprise pins projecting upwardly from said support surface of said mold table means.

* * * * *